US008061349B2

(12) United States Patent
Eiklor

(10) Patent No.: US 8,061,349 B2
(45) Date of Patent: Nov. 22, 2011

(54) GAS-FIRED ARTIFICIAL LOG BURNERS WITH HEATING CHAMBER

(75) Inventor: Scott F. Eiklor, Paoli, IN (US)

(73) Assignee: Eiklor Flames, LLC, Paoli, IN (US)

( * ) Notice: Subject to any disclaimer, the term of this patent is extended or adjusted under 35 U.S.C. 154(b) by 0 days.

(21) Appl. No.: 13/026,978

(22) Filed: Feb. 14, 2011

(65) Prior Publication Data

US 2011/0139143 A1 Jun. 16, 2011

Related U.S. Application Data

(63) Continuation of application No. 11/061,041, filed on Feb. 18, 2005, now Pat. No. 7,886,736.

(51) Int. Cl.
*F24C 3/08* (2006.01)

(52) U.S. Cl. ..... 126/512; 126/523; 126/540

(58) Field of Classification Search ..... 126/512, 126/516, 521, 523, 540
See application file for complete search history.

(56) References Cited

U.S. PATENT DOCUMENTS

| | | | | |
|---|---|---|---|---|
| 1,630,109 | A | | 5/1927 | Chandler |
| 3,362,395 | A | | 1/1968 | Peterson |
| 3,499,239 | A | | 3/1970 | Mungo |
| 3,526,984 | A | | 9/1970 | Nielsen et al. |
| 3,583,845 | A | | 6/1971 | Pulone |
| 3,671,175 | A | | 6/1972 | Campbell |
| 3,802,829 | A | * | 4/1974 | Morris ..... 431/353 |
| 3,806,306 | A | | 4/1974 | Duperow et al. |
| 3,871,355 | A | | 3/1975 | Henry |
| 3,945,369 | A | | 3/1976 | Adams et al. |
| 3,978,598 | A | | 9/1976 | Rose et al. |
| 4,026,544 | A | | 5/1977 | Plambeck et al. |
| 4,103,669 | A | | 8/1978 | Pauley |
| 4,306,537 | A | | 12/1981 | Mitchell |
| 4,582,478 | A | | 4/1986 | Hilker |
| 4,637,372 | A | | 1/1987 | Mogol et al. |
| 5,033,455 | A | | 7/1991 | Eiklor et al. |
| 5,099,591 | A | | 3/1992 | Eiklor et al. |
| 5,114,336 | A | * | 5/1992 | Karabin et al. ..... 431/125 |
| 5,243,965 | A | | 9/1993 | Maitland et al. |
| 5,297,959 | A | * | 3/1994 | Hemsath ..... 432/138 |
| 6,065,467 | A | | 5/2000 | Martin |

* cited by examiner

*Primary Examiner* — Alfred Basichas
(74) *Attorney, Agent, or Firm* — McDermott Will & Emery LLP

(57) ABSTRACT

An improved gas-fired burner for a fireplace. The gas-fired burner includes a substantially sealed enclosure. This enclosure, or "heat tank," may be of any desired shape, but is preferably of a rectangular, box-like shape. The enclosure includes an inlet port for the ingestion of relatively cold air into the enclosure, and two exit ports, for the exhaust of relatively warm air. The enclosure has a front and a back end, and both the inlet and exit ports may be secured to the back end of the enclosure.

13 Claims, 3 Drawing Sheets

FIG. 3
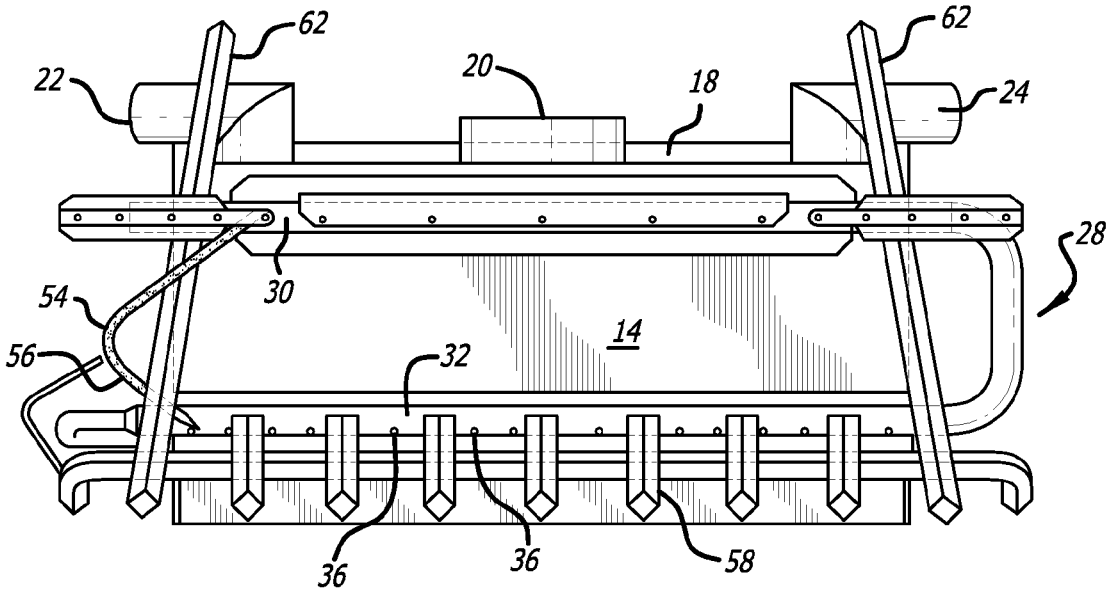
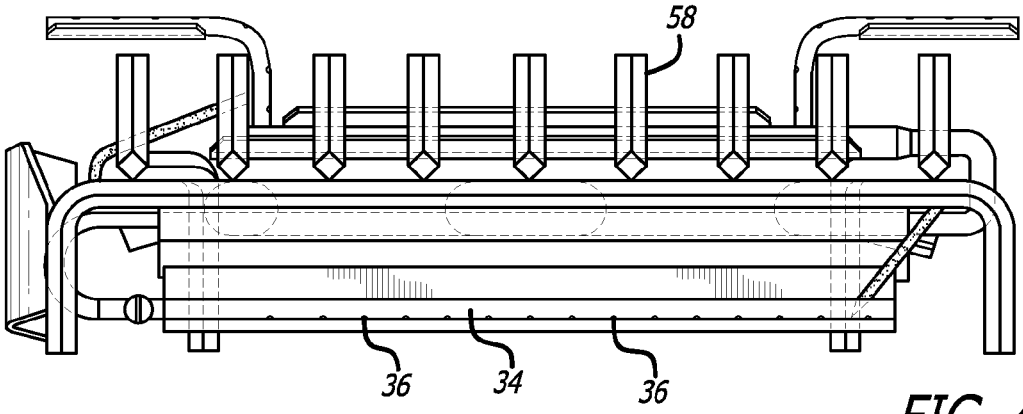
FIG. 4
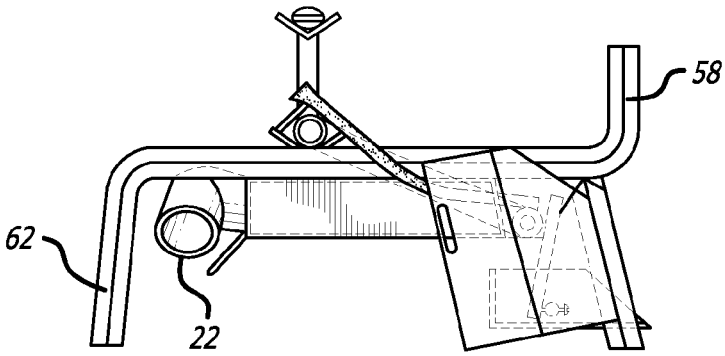
FIG. 5

GAS-FIRED ARTIFICIAL LOG BURNERS WITH HEATING CHAMBER

CROSS REFERENCE TO RELATED APPLICATIONS

This application is a Continuation Application of U.S. patent application Ser. No. 11/061,041 filed on Feb. 18, 2005, and claims priority therefrom.

TECHNICAL FIELD

The invention relates to a gas-fired artificial log burner (i.e., a "gas-fired burner") for use in a fireplace. Particularly, this invention relates to gas-fired artificial log burner with an integral air heating chamber. The heating chamber is a substantially sealed enclosure, which drastically improves the efficiency of the typical gas-fired artificial log burner.

BACKGROUND OF THE INVENTION

Conventional wood burning fireplaces or hearths have been used in buildings and homes for hundreds of years. These fireplaces have been designed to accomplish multiple purposes, but the two primary purposes are to provide heat within the building, and to provide an aesthetically pleasing light source. While wood burning fireplaces have been highly suitable aesthetic light sources, they are often inefficient as a heat source. The primary reason for this is that the heat generated by the burning wood is dispersed in multiple directions.

Wood burning fireplaces are also problematic in that the use of wood in a home can soil a room with soot, ash, and other pollutants, including vapor-borne products of combustion.

Natural gas burners, or liquid propane-gas (LPG) fired burners, eliminate much of the mess of a natural wood burning fireplace. However, such gas burners are still less efficient than desirable in converting the energy that is contained within the gas fuel, into heat that is projected into a room.

The relative inefficiency of conventional wood- and gas-burning fireplaces is an increasingly expensive problem, given the recent sharp increases in the cost of wood, fossil fuels, and other competing energy sources. Increasing energy demand from populous, underdeveloped, rapidly growing countries is likely to maintain upward pressure on energy prices.

It is believed that some inefficient conventional wood burning fireplaces remove more heat from a room than they produce. Heat losses arise when much of the heat energy caused by the burning of the wood is discharged through the chimney. Much heat from a room may be lost when fireplaces pull cold, outdoor ambient air into the house, through small gaps around windows and doors. Particularly at the beginning and end of the fire in the fireplace, these convective heat losses are larger than the radiant heat provided by that fire.

Further, the masonry walls and structures of which most fireplaces are constructed are very poor thermal insulators. This masonry is warmed by the fire and by the heated air within a room, and then conducted up through the chimney structure, and to the outside of the home. This effect further decreases the efficiency of a typical home fireplace.

These are among the reasons that the heating efficiency of such fireplaces is extremely low. Typically, as a result, a vertical-back fireplace with an open front is perhaps only ten percent efficient in converting wood to energy, and then delivering that energy into a surrounding room.

Gas burning fireplaces vary in their efficiencies. Some gas burning fireplaces are only slightly more efficient than wood-burning fireplaces. Manufacturers have devised various means for increasing the efficiency of gas-burning fireplaces. It is believed by the inventor that the typical gas-burning fireplace, however, nevertheless has a limited efficiency, particularly about 40%-42%.

The present invention is provided to solve some of the problems discussed above, and other problems, and to provide advantages and features not provided by prior gas-fired burners of this type.

What follows is a full discussion of the features and advantages of the present invention, along with explanatory drawings.

SUMMARY OF THE INVENTION

The invention is a gas-fired burner for a fireplace. The gas-fired burner includes a substantially sealed enclosure. This enclosure, or "heat tank," may be of any desired shape, but is here preferably of a rectangular, box-like shape.

Preferably, the invention provides an inlet port for the ingestion of relatively cold air into the enclosure. In addition, the enclosure includes at least one exit port, and preferably two exit ports, for the exhaust of the relatively warm air created within the enclosure. The enclosure has a front and a back end. Both the inlet and exit ports are preferably secured to the back end of the enclosure.

In the most preferred embodiment, the gas-fired burner of the invention includes a blower mechanism for pulling air from the ambient surroundings, i.e., from the generally cooler air within a room. The blower forces the cooler, ambient air into the inlet port of the enclosure, through the enclosure, and out of the exit port or ports.

The gas-fired burner includes a main gas tube. The main gas tube has a plurality of orifices for the discharge of gas. The discharging gas is typically ignited by a spark, or by a small pilot flame, to create larger flames that simulate the appearance of a natural wooden log flame. At least a portion of the main gas tube is positioned proximate or adjacent to the substantially sealed enclosure, so that the ignited gas flames are close to, or even touch, and thereby heat the substantially sealed enclosure.

The main gas tube preferably includes an upper burner, an intermediate burner, and a lower burner. In this preferred embodiment, it is the intermediate burner and the lower burner that are proximate to, and heat, the substantially sealed enclosure.

An elongated inlet duct is secured between the discharge of the blower mechanism and the inlet port of the substantially sealed enclosure. The blower mechanism feeds relatively cool, ambient air through the inlet duct, and then into the substantially sealed enclosure.

In addition, an exhaust duct is secured to each of the one or more exit ports. The blower assists in the evacuation of the substantially sealed enclosure, so that the air that is heated within that enclosure is moved through the enclosure, out of the enclosure through the exit port, and then through the exhaust duct, for discharge of that heated air into a room. This structure substantially increases the efficiencies of gas-fired burners, like the gas-fired burners of the invention.

The gas-fired burner of the invention includes a pilot tube. This pilot tube is connected to, and in communication with, a portion of the main gas tube. The pilot tube includes at least one orifice, and that orifice is positioned proximate to a pilot light. The pilot light ignites fuel that enters the pilot tube, and the ignited gas within the pilot tube in turn ignites the gas within the main gas tube to create a realistic-looking flame.

The gas-fired burner may include a plurality of upright arms. These arms are used for the support of artificial gas logs that are placed proximate to the gas-fired burner. These upright arms may curve downwardly, to form integral support legs for the gas-fired burner.

The upper burner of the invention may include at least one auxiliary burner. This auxiliary burner is secured to, and communicative with, the upper burner. This auxiliary burner enhances the aesthetically pleasing appearance of the gas-fired burner of the invention.

Other features and advantages of the invention will be apparent from the following specification, taken in conjunction with the following drawings.

BRIEF DESCRIPTION OF THE DRAWINGS

To understand the present invention, it will now be described by way of example, with reference to the accompanying drawings.

FIG. 3 is a top view of the artificial log burner of FIG. 1.

FIG. 4 is a rear view of the artificial log burner of FIG. 1.

FIG. 5 is a right-side view of the artificial log burner of FIG. 1.

DETAILED DESCRIPTION

The invention is susceptible of many different forms or embodiments. The drawings show, and the specification describes in detail, a preferred embodiment of the invention. The present disclosure and drawings are to be considered as an example of the principles of the invention. The disclosure and drawings are not intended to limit the broad aspect of the invention to the illustrated embodiments.

Figure 1:
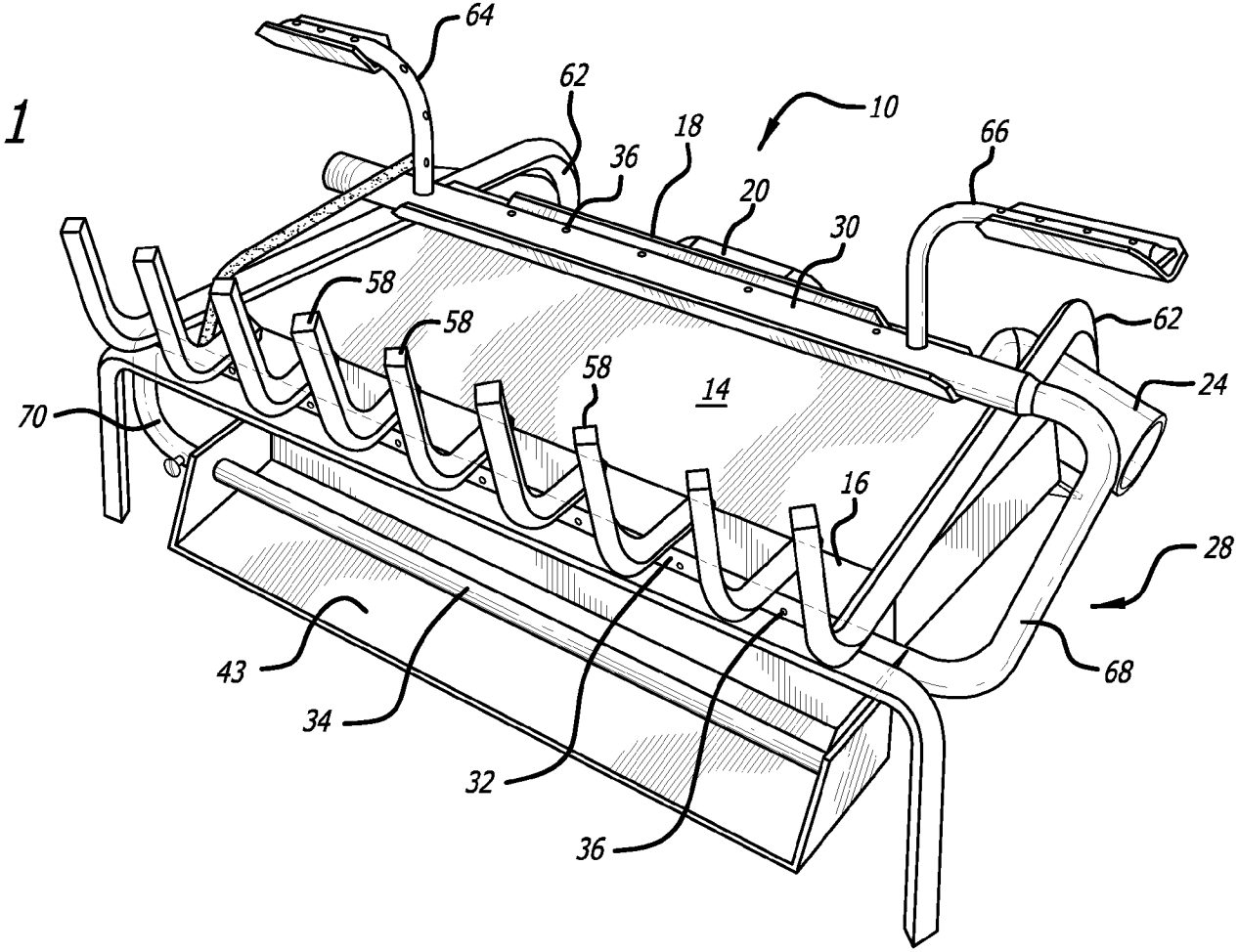
FIG. 1 is a perspective view of a preferred embodiment of the gas-fired artificial log burner of the invention.
Figure 2:
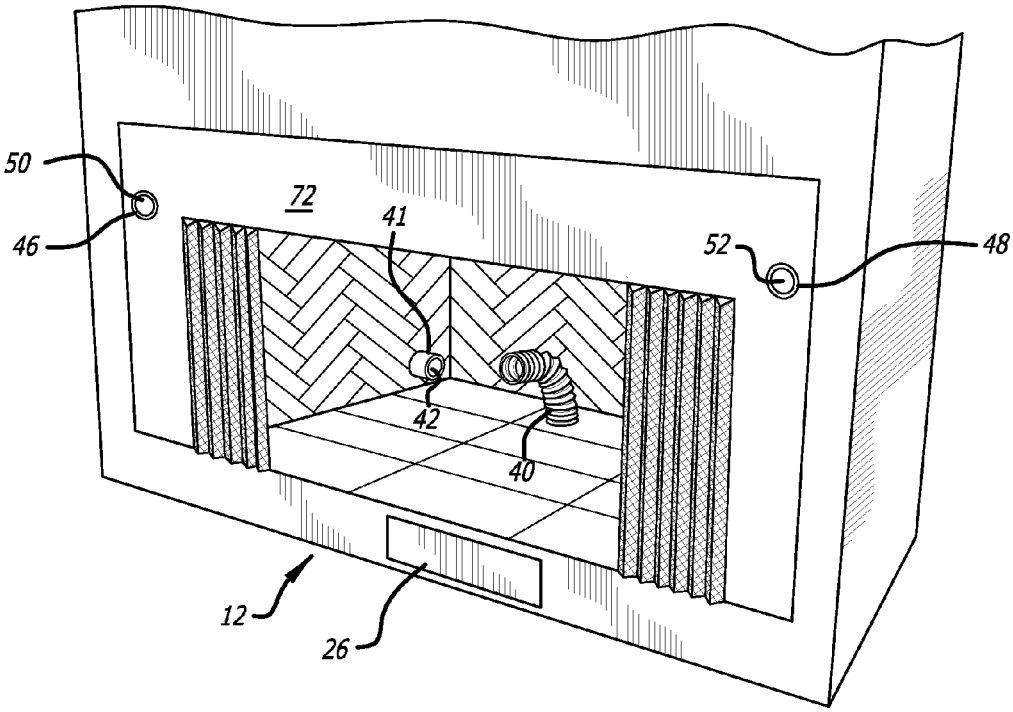
FIG. 2 is a perspective view of a fireplace in which the log burner of the invention is placed.

Referring now to FIGS. 1 and 2, the invention is a gas-fired burner 10 for a fireplace 12. The gas-fired burner 10 is generally similar in construction to prior art gas-fired burners, such as those disclosed in U.S. Pat. No. 5,033,455, to Eiklor et al., issued on Jul. 23, 1991. However, the gas-fired burner 10 of the present invention includes certain additional components, including an important, integral energy saving component.

That component can best be seen in FIG. 1, and comprises a box-like, substantially sealed enclosure 14 The enclosure 14 may alternatively be called a "heat tank." The inventor defines the term "substantially sealed" to mean that the enclosure 14 is sealed, and except for an inlet port or an exit port, to be described later, is relatively air- or watertight.

In the present embodiment, for example, the substantially sealed enclosure 14 is made of 20-gauge, 304 stainless steel. It has a generally rectangular shape, similar to the shape of, but flatter than, a shoe box. In this embodiment, the overall dimensions of the substantially sealed enclosure 14 are nineteen (19") inches long, six and one-half (6½") inches wide, and one and three quarters (1¾") inches high.

The "residence time" is the average amount of time that air spends within the substantially sealed enclosure 14. The residence time is a factor of (a) the dimensions, and thus the volume, of the substantially sealed enclosure 14; and (b) the volumetric capacity of the blower that moves air into and out of that enclosure 14. In general, the greater the residence time of the air within the enclosure 14, the higher the difference between the temperature of the air that enters the enclosure 14 and the temperature of the air that is discharged from the enclosure 14.

While the present embodiment provides a substantially sealed enclosure 14 having a rectangular box-like shape, it will be understood by those of skill in the art that the enclosure 14 may be of any desired shape.

As may best be seen in FIGS. 1 and 3, the enclosure 14 includes a front side 16 and a back side 18. In this preferred embodiment, the back side 18 of the enclosure 14 includes an inlet port 20 for the ingestion of relatively cold air into the enclosure 14. The cold air that is ingested into the enclosure 14 through this inlet port 20 is typically ambient air that is relatively cold, e.g., about 60 to 70 degrees F., and that is taken from the room of a home in which the fireplace 12 is situated. In this embodiment, the inlet port 20 is of a generally oval shape, with the oval being approximately 3½" along its widest horizontal dimension, and approximately 2" along its widest vertical dimension.

In addition, adjacent the inlet port 20, the back side 18 of the enclosure 14 includes at least one exit port for the discharge of relatively warm air from the enclosure 14. The warm air that is discharged from the enclosure 14 through the exit port is the ambient air that was taken from the room of the home in which the fireplace 12 is situated, and heated, while within the substantially sealed enclosure 14. While only one exit port is necessary, the present embodiment includes two exit ports, a first exit port 22 and a second exit port 24. In this embodiment, the two exit ports 22 and 24 are of a generally circular shape, with the diameter of each exit port 22 and 24 being approximately 1¼".

Preferably, as suggested above, the gas-fired burner 10 of the invention includes a blower mechanism 26 (or "blower") for pulling air from the ambient, e.g., from the room within which the fireplace 12 is situated. The blower 26 provides sufficient pressurization of the relatively cold ambient air to pull that cold air from the room, through the blower 26, into the inlet port 20, through the substantially sealed enclosure 14, and out through the exit ports 22 and 24 for discharge, as heated air, into that same room.

As may best be seen in FIG. 1, the gas-fired burner 10 includes a main gas tube 28. In this embodiment, the main gas tube 28 has three separate portions: a first portion or upper burner 30, a second portion or intermediate burner 32, and a third portion or lower burner 34.

The upper burner 30 of the main gas tube 28 may be seen in FIGS. 1 and 3, the first portion 30 is made of piping having a relatively large diameter, i.e., one-half (½) inch. The intermediate burner 32 of the main gas tube 28 has a somewhat narrower diameter, i.e., three-eighths (⅜) of an inch. The lower burner 34 of the main gas tube 28 has the narrowest diameter, i.e., one-quarter (¼) of an inch. The junctions of both the upper burner 30 and the intermediate burner 32, and the intermediate burner 32 and the lower burner 34 of the main gas tube 28, are welded together, via U-shaped connectors 68 and 70, respectively.

Each of the three burners 30, 32, and 34 of the main gas tube 28 have a plurality of orifices 36 for the discharge of natural or liquid propane gas. The discharging gas is ignited by a spark or flame, to create flames that simulate the appearance of a natural, log-induced flame.

At least a portion of the main gas tube 28 is proximate to the substantially sealed enclosure 14, so that the ignited gas flames are close to, or even touch, and thereby heat the substantially sealed enclosure 14.

In this preferred embodiment, it is the intermediate burner 32 and the lower burner 34 that are proximate to, and heat, the substantially sealed enclosure 14. As may be seen in FIG. 3, at least intermediate burner 32 is positioned such that its flames touch the substantially sealed enclosure 14. As a result, the substantially sealed enclosure 14 is heated to a high temperature.

In addition, the lower burner 34 provides substantial additional heating for the enclosure 14. Typically, as may be seen in FIG. 1, a pan 43 is filled with vermiculite. The flames from the lower burner 34 heat the vermiculite, and provide much thermal energy to the bottom of the enclosure 14.

The energy transmitted to the substantially sealed enclosure 14 by these flames is carried away from that enclosure 14 by air that enters, and is then withdrawn from, that enclosure 14. The air enters that enclosure 14 at a relatively low temperature, absorbs the heat energy transmitted by the flames to that enclosure 14, and exits that enclosure 14 at a relatively high temperature.

As noted above, in order to move the air through that enclosure 14, as depicted in FIG. 2, a blower mechanism 26 is provided. The blower mechanism 26 of the present invention has a capacity of 250 cubic feet per minute (cfm). Air from the ambient, i.e., from the room in which the artificial gas log burner 10 is installed, is ingested into the blower mechanism 26. That air is pressurized within the blower mechanism 26, and then discharged under pressure into a flexible, cylindrical elongated inlet duct 40. This duct 40 is made of heat- and flame-resistant materials, which can successfully exist in the high temperature fireplace environment.

This duct 40 takes pressurized air from the blower mechanism 26 and transmits it to the inlet port 20 of the substantially sealed enclosure 14.

In this embodiment, there are no internal structures in the substantially sealed enclosure 14. However, it will be understood by those of skill in the art that internal structures, such as baffles, may optionally be provided in the interior of the enclosure 14. Such baffles can extend the effective path of the air moving through the enclosure 14, and thus increase the residence time of the air within the enclosure 14.

After the pressurized air from the blower mechanism 26 enters the inlet port 20, it passes through the interior of the substantially sealed enclosure 14 and is heated by virtue of its contact with the hot walls of that enclosure 14. The air has a relatively short residence time within the enclosure 14. However, during even this limited residence time, the temperature of the air increases substantially. For example, in the embodiment described in this specification and shown in the attached Figures, the air is heated from approximately 70 degrees F. to approximately 130 degrees F.

The air that is heated within the substantially sealed enclosure 14 must be discharged from that enclosure 14. To effect this, elongated exhaust ducts 42 and 44 are secured to each of the exit ports 22 and 24. These exhaust ducts 42 and 44 operate in the same high-temperature environment as inlet duct 40, and are thus preferably made of the same heat- and flame-resistant materials as inlet duct 40.

In FIG. 2, a first distal end 41 of the exhaust duct 42 is shown. The second distal end 46 of the exhaust duct 42 is also shown in this FIG. 2. Exhaust duct 42 is elongated, and extends between the first distal end 41 and the second distal end 46. Heated air is transported in this exhaust duct 42. As may also be seen in FIG. 2, the exhaust duct 42 extends through a left vertical wall of the fireplace 12.

While only one distal end 48 of the exhaust duct 44 is shown, the placement of that exhaust duct 44 in the fireplace 12 is essentially a mirror image of the placement of the exhaust duct 42 within the fireplace 12. Particularly, that exhaust duct 44 extends through a right vertical wall of the fireplace 12. The distal end 48 of the exhaust duct 44 is positioned so as to discharge heated air.

Particularly, the heated air is recirculated back into the room in which the fireplace 12 resides. There are many possible ways of recirculating that air. As but one example, in this embodiment, as may best be seen in FIG. 2, such recirculation is effected by placing the distal ends 46 and 48 of each of the elongated exhaust ducts 42 and 44, respectively, so that they feed into openings 50 and 52. These openings 50 and 52 are positioned upon the flat vertical face 72 of the fireplace 12. The heated air is discharged into the room through these openings 50 and 52.

Summarizing the above, it may be seen that the blower mechanism 26 feeds cold, pressurized air into the substantially sealed enclosure 14. The blower mechanism 26 further assists in the evacuation of the substantially sealed enclosure 14, moving the air as it is being heated within that enclosure 14, and then moving that air through exit ports 22 and 24, through the exhaust ducts 42 and 44, and then finally through the openings 50 and 52. This results in the discharge of that heated air into the room.

The present gas fired burner 10 is believed to be substantially more efficient than the gas-fired burners of the prior art. Prior art gas fired burners relied upon convection to heat the room. Particularly, heat from the flames of such prior art gas fired burners is projected horizontally and outwardly into the room in which the fireplace was installed. However, much of the heat is also projected upwardly, and is thus lost through the chimney. As a result, the inventor believes that the thermal efficiency of such prior art gas fired burners is only about 40-42%.

In contrast, the present gas fired burner 10 captures much of this lost heat by virtue of its additional structure, including but not limited to the substantially sealed enclosure 14. The structure described above is believed to increase the efficiency of the typical gas-fired burner to perhaps between 60 and 70%.

As may best be seen in FIG. 3, the gas-fired burner 10 of the invention includes a pilot tube 54. This pilot tube 54 is connected to, and is in communication with, the main gas tube 28. In this embodiment, the pilot tube 54 feeds into the first portion or upper burner 30 of the main gas tube 28. The pilot tube 54 includes at least one orifice 56, preferably on its underside. This orifice 56 is positioned proximate to a pilot light (not shown). Typically, the pilot light is constantly lighted.

When a gas valve (not shown) is opened, natural gas or liquid propane gas (LPG) enters the gas-fired burner 10 through the main gas tube 28, and particularly its upper burner 30. From this upper burner 30, a portion of that gas enters the pilot tube 54. That gas then moves toward the orifice 56 of the pilot tube 54, where it is ignited by the pilot light (not shown).

The ignited gas within the pilot tube 54 in turn ignites the gas in the main gas tube 28, including the upper burner 30, the intermediate burner 32, and the lower burner 34.

The gas-fired burner may include a plurality of upright arms 58. These arms 58 are used for the support of artificial gas logs that are placed, in a well-known manner, at a location proximate to the gas-fired burner 10. A lower portion of these upright arms 58 may curve downwardly, to form a pair of integral support legs 60 and 62 for the gas-fired burner 10.

The upper burner 30 of the gas fired burner 10 may include at least a first auxiliary burner 64. In this embodiment, the gas-fired burner 10 also includes a second auxiliary burner 66. These first 64 and second 66 auxiliary burners are secured to, and communicative with, the upper burner 30. In other words, the auxiliary burners 64 and 66 are secured to the upper burner 30 in a manner that permits either the natural gas or the LPG from the upper burner 30 to enter the auxiliary burners 64 and 66. These auxiliary burners 64 and 66 enhance the aesthetically pleasing appearance of the burner 10 of the invention.

While the specific embodiments have been illustrated and described, numerous modifications come to mind without significantly departing from the spirit of the invention. The scope of protection is only limited by the scope of the accompanying Claims.

What is claimed is:

1. A gas-fired burner for a fireplace, the burner comprising: a substantially sealed enclosure;

a gas tube having a plurality of orifices for the discharge of gas, at least a portion of the gas tube being sufficiently proximate to the substantially sealed enclosure, so that the flames created by the discharge of the gas from the gas tube directly touch and heat the substantially sealed enclosure, the enclosure including an inlet port for the ingestion of relatively cold air, and at least one exit port for the exhaust of relatively warm air.

2. The gas fired-burner of claim 1, wherein the enclosure includes at least two exit ports.

3. The gas-fired burner of claim 1, wherein the enclosure includes a front and a back end, and wherein the inlet port is secured to the back end of the enclosure.

4. The gas-fired burner of claim 1, wherein the enclosure includes a front and a back end, and wherein the exit port is secured to the back end of the enclosure.

5. The gas-fired burner of claim 1, further comprising a blower mechanism for pulling air from the ambient, into the inlet port, through the enclosure, and out of the at least one exit port.

6. The gas-fired burner of claim 5, further comprising a inlet duct secured between the blower mechanism and the inlet port for feeding ambient air into the substantially sealed enclosure.

7. The gas-fired burner of claim 5, further comprising at least one exhaust duct secured to the at least one exit port, for taking heated air from the substantially sealed enclosure, and discharging the heated air into a room.

8. The gas-fired burner of claim 5, further comprising a plurality of upright arms for supporting artificial gas logs that are positioned proximate to the gas-fired burner.

9. The gas-fired burner of claim 5, wherein the main gas tube includes an upper burner, an intermediate burner, and a lower burner.

10. The gas-fired burner of claim 9, further comprising a pilot tube in communication with the main gas tube, the pilot tube including at least one orifice for positioning proximate a pilot light.

11. The gas-fired burner of claim 9, wherein the intermediate burner and the lower burner are sufficiently proximate to the substantially sealed enclosure so that the flames created by the discharge of the gas from the gas tube directly touch and heat the substantially sealed enclosure.

12. The gas-fired burner of claim 11, wherein the upper burner includes at least one auxiliary burner, secured and communicative to the upper burner.

13. The gas-fired burner of claim 1, wherein the upright arms curve downwardly to form integral support legs for the gas-fired burner.

* * * * *